United States Patent [19]

Lichtenberger

[11] 4,163,620

[45] Aug. 7, 1979

[54] METHOD AND APPARATUS FOR INCREASING THE VERTICAL LOAD BEARING CAPACITY OF ICE

[75] Inventor: Gunter J. Lichtenberger, Dallas, Tex.

[73] Assignee: Sun Oil Company, Ltd., Calgary, Canada

[21] Appl. No.: 881,441

[22] Filed: Feb. 27, 1978

[51] Int. Cl.[2] ..... F25D 1/00

[52] U.S. Cl. ..... 405/217; 114/123; 114/270; 405/61

[58] Field of Search ..... 114/270, 121, 123, 45, 114/52, 53, 54, 40, 334; 405/61, 217

[56] References Cited

U.S. PATENT DOCUMENTS

| | | | |
|---|---|---|---|
| 638,342 | 12/1899 | Lake | 114/334 X |
| 3,130,701 | 4/1964 | Langballe | 114/40 |
| 3,811,583 | 5/1974 | Weeks | 114/45 X |
| 3,872,813 | 3/1975 | Broadfoot | 114/44 X |

*Primary Examiner*—Trygve M. Blix
*Assistant Examiner*—Sherman D. Basinger
*Attorney, Agent, or Firm*—J. Edward Hess; Donald R. Johnson; James H. Phillips

[57] ABSTRACT

In order to increase the vertical load bearing capacity of an ice field such as may be found in the Arctic, whereby buildings, drilling rigs, or the like may be supported, an inflatable hull is positioned beneath the ice, initially in deflated form. Inflation of the hull is carried out in conjunction with application of the load under control of level sensor means which govern the rate of inflation according to the deflection of the ice as the load is applied. Very high load bearing capacity may be obtained and maintained, even for relatively thin ice, within a short period. Degree of inflation control apparatus may be employed to accomodate varying loads, and a multiple-hull system is contemplated for practicing the invention over relatively large areas.

6 Claims, 11 Drawing Figures

METHOD AND APPARATUS FOR INCREASING THE VERTICAL LOAD BEARING CAPACITY OF ICE

BACKGROUND OF THE INVENTION

This invention relates to ice structures, and, more particularly, to means for increasing the vertical load bearing capacity of an ice sheet.

The depletion of relatively easy-to-reach oil and natural gas reserves and the remarkable increase in the worldwide value of oil and gas has brought about intensified exploration and production efforts in the harshly cold areas of the world such as the Arctic. This activity comprehends both onshore and offshore efforts, and the latter includes its own particularly difficult problems. The year-round use of conventional drillships or drilling platforms is precluded because of the tremendous forces exerted by the shifting ice which is universally present during at least a part of the year in these regions. Specially configured drillships and drilling platforms, as well as semi-submersible structures, have been constructed and/or proposed to deal with the problems associated with offshore operation in ice covered areas. Additionally, it has been proposed to employ the ice itself to support either drilling and production apparatus or logistics support buildings such as personnel housing, storage warehouses, storage tanks and the like.

One factor which has limited the direct use of the sheet ice to support such structures has been its limited and variable strength. Thus, those skilled in the art will appreciate that it would be highly desirable to provide means by which the load bearing strength of an ice sheet may be predictably and significantly augmented, and it is to this end that the present invention is directed.

It is therefore a broad object of this invention to provide means for increasing the load bearing strength of an ice sheet.

It is another object of this invention to provide such means by which the strength augmentation is effected predictably and in accordance with the load to be borne.

It is yet another object of this invention to provide such means which is relatively simple to incorporate into the load bearing system and which is reliable in operation.

In another aspect, it is an object of this invention to provide such means by which the use of a plurality of load strength augmentation units are used in coordination to accomodate varying loads across a large area of the ice sheet.

SUMMARY OF THE INVENTION

Briefly, these and other objects of the invention are achieved by inserting an inflatable hull, in its deflated state, beneath the ice in the region which is to be subjected to a load. As the load is applied, the inflatable hull is inflated to apply an upwardly directed force to the underside of the ice. By monitoring ice deflection with an inclinometer or the like, the rates at which the load is applied and at which the inflatable hull is inflated may be coordinated such that the load bearing capacity of the ice may be greatly agumented without fracturing the ice. Degree-of-inflation control means may be employed to accomodate changing loads by bleeding or further inflating the hull. A multiple hull system is used to support an ice sheet area larger than can readily be handled by a single inflatable hull.

DETAILED DESCRIPTION OF THE INVENTION

The subject matter of the invention is particularly pointed out and distinctly claimed in the concluding portion of the specification. The invention, however, both as to organization and method of operation, may best be understood by reference to the following description taken in connection with the subjoined claims and the accompanying drawing, of which:

Figure 1:
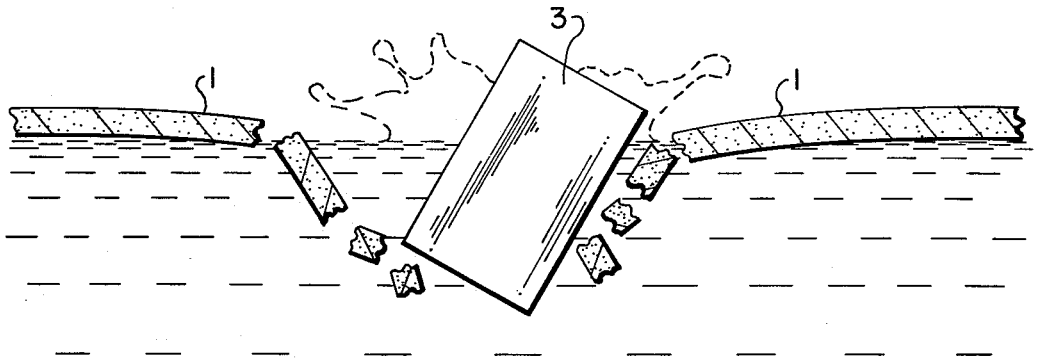
FIG. 1 is a pictorial view illustrating the effect of applying a load which exceeds the strength of an ice sheet.

Referring to FIG. 1, an ice sheet 1 overlaying a body of water 2 is shown to fracture upon application of a load 3 which exceeds the natural load bearing capacity of the ice sheet 1.

Figure 2:
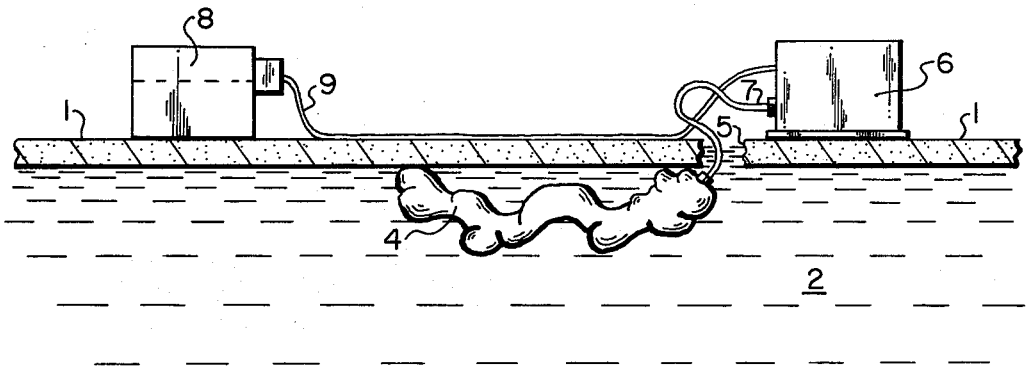
FIG. 2 is a pictorial view illustrating the manner in which apparatus comprising the present invention may be deployed.

In FIG. 2, apparatus according to the present invention is illustrated in a region of the ice sheet 1 which is subsequently to receive a substantial load. An inflatable flexible walled hull 4 is introduced beneath the ice sheet through an opening 5 chopped or otherwise made in the ice sheet 1. The inflatable hull 4 is coupled to the output of an air compressor 6, situated on the surface of the ice sheet 1, by a flexible hose 7. Level sensing and control means 8 serves to monitor the deflection of the ice and to accordingly govern the rate of inflation of the inflatable hull 4 by the air compressor 6 as will be more particularly set forth below. Electrical cable 9 serves to connect the level sensing and control means 8 to the compressor 6.

Figure 3:
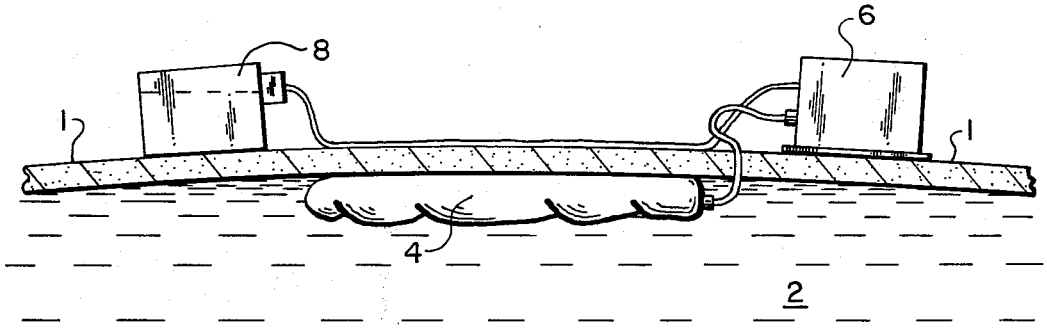
FIG. 3 is a pictorial view illustrating the effect of carrying out a partial inflation step in the process by which the present invention is employed.

In FIG. 3, inflation of the inflatable hull 4 by the compressor 6 has been partially carried out such that the ice sheet 1 bows upwardly in the region above the inflatable hull 4 due to the increased hull buoyancy. The level sensing and control means 8 responds to this deflection by causing the compressor 6 to slow or stop further inflation of the inflatable hull 4 to avoid fracturing the ice sheet 1 upwardly.

Figure 4:
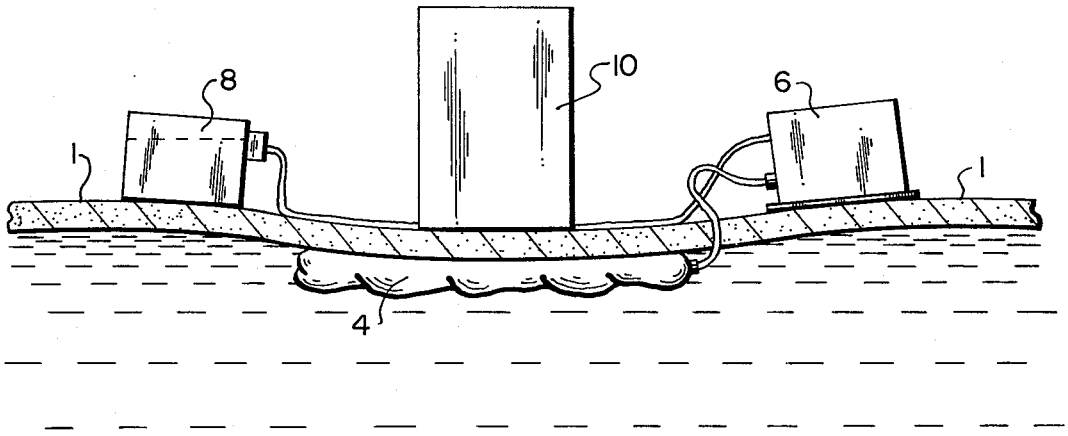
FIG. 4 illustrates the effect of applying a load to the ice sheet in the region of the apparatus depicted in FIG. 3.

In FIG. 4, a load 10 has been placed on the ice sheet 1 above the region partially supported by the inflatable hull 4. The level sensing and control means 8 responds to the downward deflection of the ice in the region beneath the load 10 by calling upon the compressor 6 to further inflate the inflatable hull 4.

Figure 5:
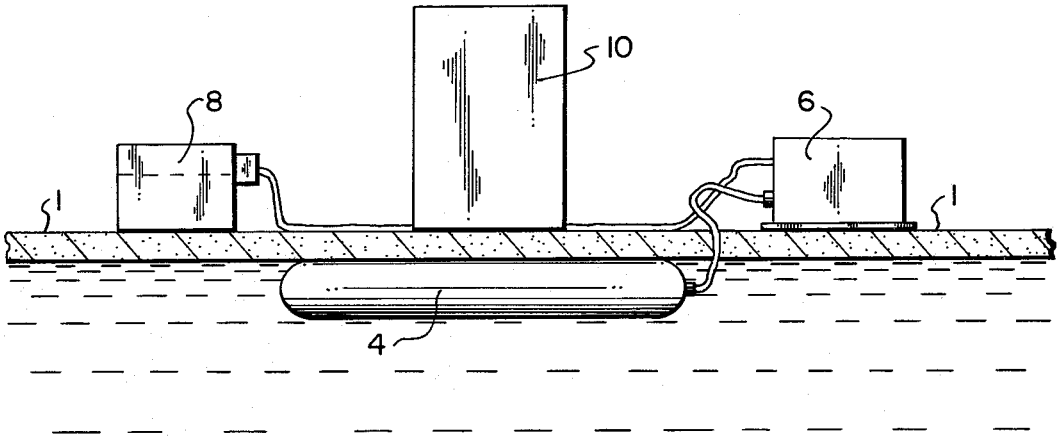
FIG. 5 illustrates a steady state condition illustrating the manner in which an ice sheet may support a heavy load in conjunction with the load bearing augmentation capabilities of the present invention.

FIG. 5 illustrates an equilibrium condition in which the lift provided to the underneath side of the ice sheet 1 by the inflatable hull 4 just balances the downward force applied to the upper surface of the ice sheet by the load 10. Thus, the load 10 is readily supported on the ice sheet even though its weight may apply a pressure thereto which would ordinarily cause the ice sheet to fracture.

It will be appreciated that the sequence illustrated in FIGS. 2–5 is simply exemplary and that the actual sequence followed in a given ice region will depend upon the thickness of the ice, the dimensions and volumetric capacity of the inflatable hull 4, and the weight and distribution of the load 10. Further, should the load be altered, as for example, where a tank is either loaded or unloaded, the charge of air within the inflatable hull 4 must be adjusted to maintain ice deflection, as sensed by the level sensing and control means 8, within prescribed limits. It will be understood, therefore, that it may be necessary for the inflatable hull 4 to be bled back through the compressor 6 or through a separate valve. One manner in which these operations may be carried out is set forth below.

Figure 6:
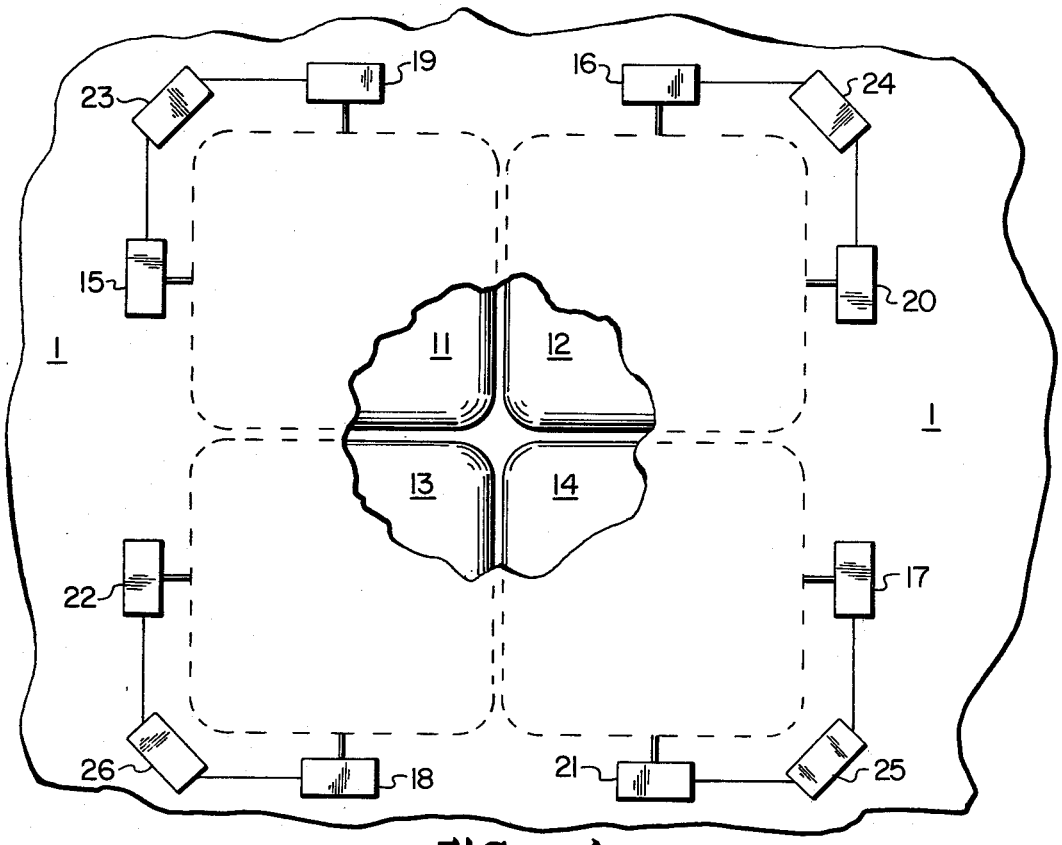
FIG. 6 is a plan view illustrating the deployment of a load augmentation system employing multiple inflatable hull.

Thus, as shown in FIG. 6, a group of four inflatable hulls 11, 12, 13, 14, each of which is generally rectangular in shape, is disposed in an array to support a correspondingly-sized region of the ice sheet. The inflatable hulls 11, 12, 13 and 14, are coupled, respectively, to compressors 15, 16, 17 and 18 and to bleed valves 19, 20, 21, and 22. A level sensing and control means 23, situated proximate the outboard corner of the inflatable hull 11, controls the operation of the compressor 15 and bleed valve 19. Similar and correspondingly situated level sensing and control means 24, 25, 26 control the operation, respectively, of the compressor 16 and bleed valve 20, the compressor 17 and bleed valve 21, and the compressor 18 and bleed valve 22. Thus, it will be understood that the inflatable hulls 11, 12, 13, 14 are individually controllable to handle varying loads by responding to a downward deflection, as sensed by the individual control means, causes the corresponding bleed valve to partially deflate the inflatable hull.

Figure 7:
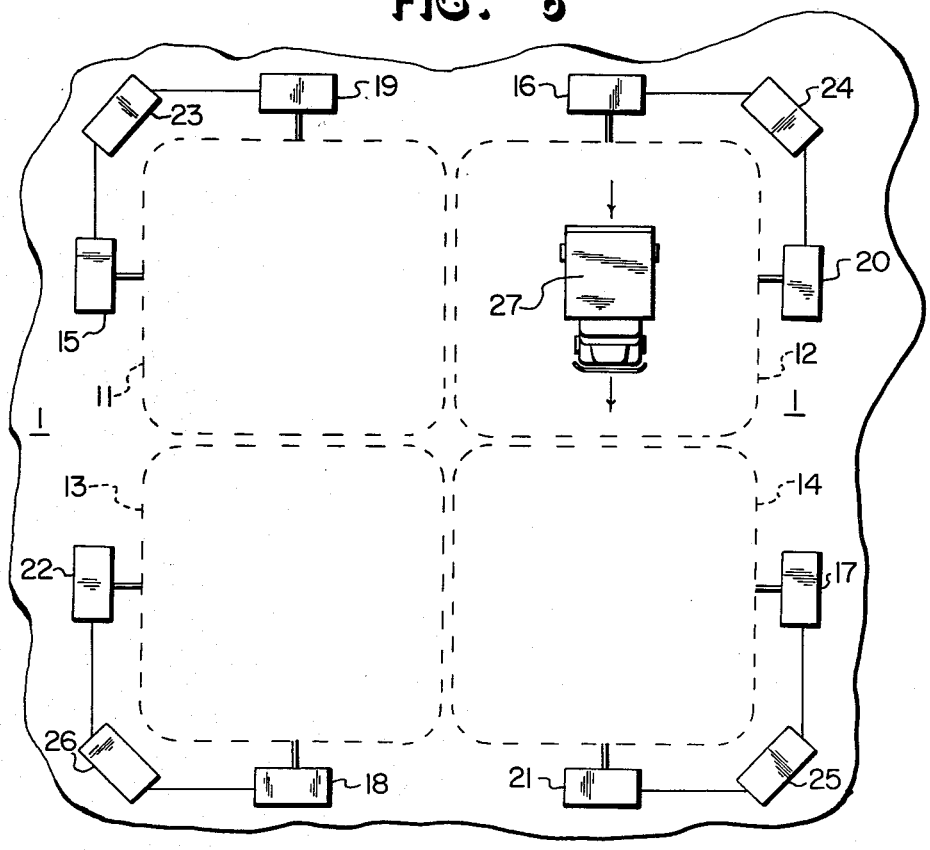
FIG. 7 is a view similar to FIG. 6 illustrating the effect of applying a heavy load in one region of the supported area.

By way of example, assume, as shown in FIG. 7, that a moving load, such as a truck 27, is driven onto the ice sheet directly above the inflatable hull 12. The level sensing control means 24 responds to the sensed downward deflection of the ice sheet by calling upon the compressor 16 to further inflate the inflatable hull 12 until, within the range of sensitivity, no deflection is observed by the level sensing and control means 23. If the truck 27 is heavy enough to deflect the ice sheet such that any or all the other level sensing and control means 23, 25, 26 also sense deflection, they too will initiate further inflation of their respective inflatable hulls to such individual extents as may be necessary to maintain an equilibrium state across the entire supported area.

Figure 8:
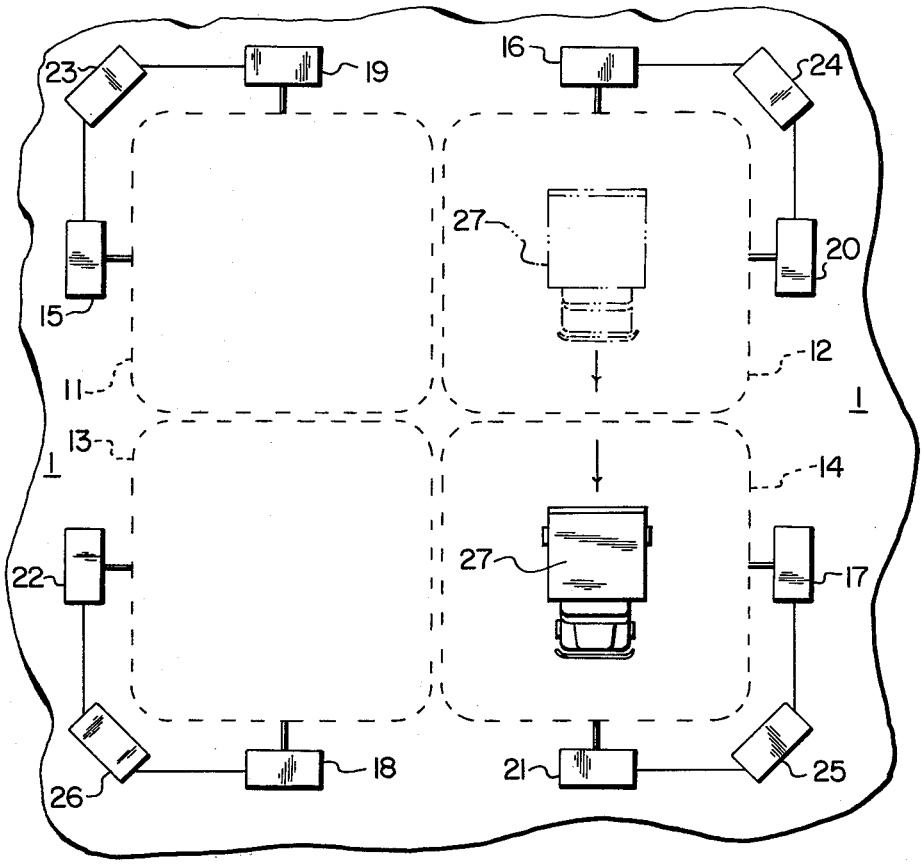
FIG. 8 is a plan view illustrating the effect of moving the heavy load shown in FIG. 7 from one region to another region of the supported area.

Referring now to FIG. 8, it will be observed that the truck 27 has moved from a region above the inflatable hull 12 to a region above the inflatable hull 14. As a result, the inflatable hull 12, previously further inflated to accomodate the added weight of the truck 27, tends to bow the ice sheet upwardly, a condition sensed by the level sensing and control means 24 which responds by actuating the bleed valve 20 to deflate the inflatable hull 12 until equilibrium is again reached. Conversely, the added weight applied to the truck 27 to the ice sheet in the region above the inflatable hull 14 causes a downward deflection which is sensed by the level sensing and control means 25. As a result, the level sensing and control means 25 causes the compressor 17 to further inflate the inflatable hull 14 until an equilibrium condition is reached. Any upward or downward deflection sensed by the level sensing and control means 23 and 26 will result in the appropriate corrective deflation or inflation to the inflatable hulls 11 and 13.

Figure 9:
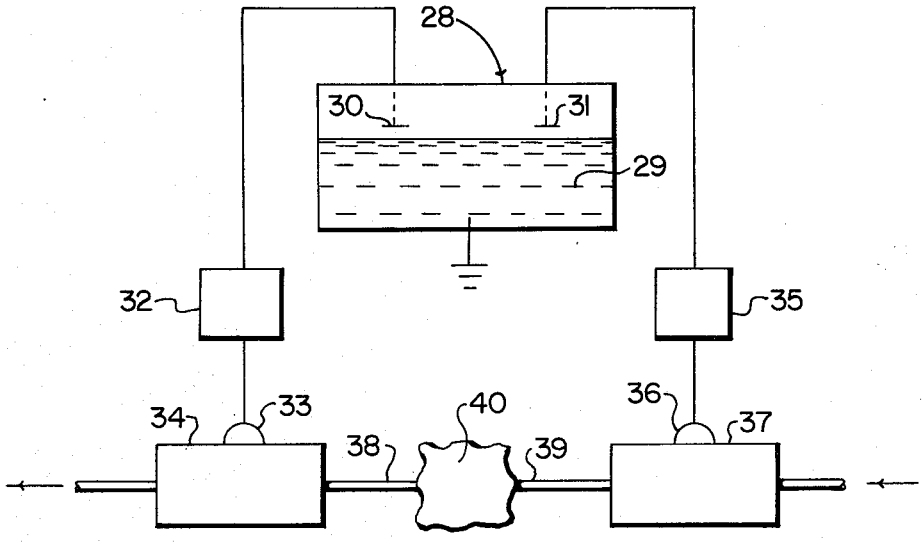
FIG. 9 is a schematic block diagram of the load sensing and control means by which a hull is further inflated or deflated to maintain an equilibrium condition.

The level sensing and control means 23, 24, 25, 26, may take diverse forms. One simple configuration is illustrated in FIG. 9. A container 28 is partially filled with a conductive liquid 29 which is connected to a reference potential such as ground. Separate electrodes 30 and 31 are suspended such that they are slightly above the upper surface of the conductive liquid 29 when the container 28 is horizontally disposed. The electrode 30 is connected to air valve drive circuit 32 which may be configured to actuate a solenoid 33 to open an air valve 34 when a ground potential is sensed at the drive circuit input. Similarly, the electrode 31 is connected to a compressor drive circuit 35 which is configured to actuate a solenoid 36 to start compressor 37 when ground potential is sensed at the input to the circuit 35. Hoses 38 and 39 couple, respectively, the inlet to the air valve 34 and the exhaust of the compressor 37 to the interior of the inflatable hull 40.

Figure 10:
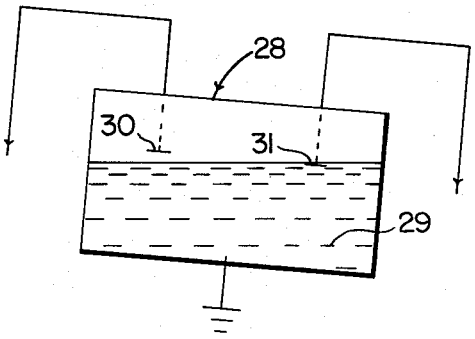
FIG. 10 illustrates the load sensing means of FIG. 9 in a first non-equilibrium position.

Consider now the effect occasioned by sufficient tilt of the container 28 such that the upper surface of the grounded liquid 29 contacts the electrode 31 as shown in FIG. 10. It will be presumed that the container 28 has been placed such that the condition shown in FIG. 10 corresponds to a downward deflection of the ice in the region above the inflatable hull 40. With the electrode 31 now at ground potential, the circuit 35 responds by actuating the solenoid 36 to start the compressor 37 to further inflate the inflatable hull, and the compressor 37 will continue to operate until the container 28 has sufficiently approached the horizontal to break the engagement between the electrode 31 and the upper surface of the conductive liquid 29.

Figure 11:
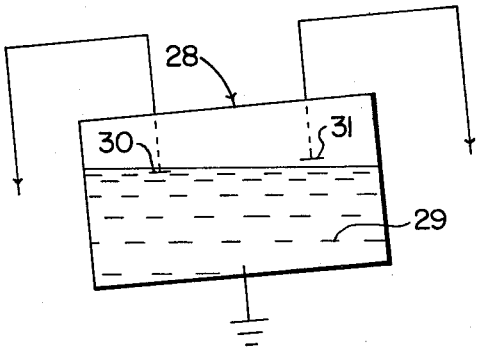
FIG. 11 illustrates the load sensing means of FIG. 9 in a second non-equilibrium position.

Conversely, as shown in FIG. 11, if the ice sheet bows upwardly, as when a load is removed from the monitored region, and the container 28 tilts until the upper surface of the conductive liquid 29 contacts the electrode 30, the circuit 32 responds by actuating the solenoid 33 to open the air valve 34 whereby air within the inflatable hull 40 is bled through the hose 38. Such bleeding will continue until the container 28 settles sufficiently back toward the horizontal for the upper surface of the conductive liquid 29 to fall away from the electrode 30, thus removing the ground potential input to the circuit 32. It may be noted that the ice sheet angles which cause the respective electrodes 30, 31 to contact the conductive liquid 29 are inherently predetermined according to the level of the conductive liquid 29 in the container 28 and the vertical position of each electrode.

Those skilled in the art will appreciate that many variations of specific elements within the basic concept of the present invention may be employed. For example, in a multiple inflatable hull system, a single compressor may feed, in parallel, through an appropriate manifold and valving arrangement, any combination of the inflatable hulls which may be calling for further inflation. Similarly, the inclination sensing means may comprise strain gauge deflection sensors or other functionally similar devices rather than the level sensor illustrated in FIG. 9.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A method for increasing the load bearing capacity of a natural ice sheet comprising the steps of:

(A) introducing an inflatable member beneath the ice sheet in the predetermined area;

(B) inflating the inflatable member;

(C) monitoring the inclination of the ice sheet in the predetermined area; and (D) terminating the inflation step when the inclination reaches a predetermined angle.

2. The method of claim 1 which includes the step of applying a load to the ice sheet in the predetermined area during the inflation step.

3. The method of claim 2 which includes the subsequent steps of:

(A) removing a load from the ice sheet in the predetermined area;

(B) partially deflating the inflatable member;

(C) monitoring the inclination of the sheet ice in the predetermined area; and (D) terminating the deflation step when the inclination reaches a predetermined angle.

4. Apparatus for increasing the load bearing capacity of a predetermined area of a natural ice sheet comprising:

(A) an inflatable member adapted for insertion beneath the ice sheet in the predetermined area;

(B) means for inflating said inflatable member;

(C) means for sensing the inclination of the ice sheet in the predetermined area; and (D) means responsive to sensing, by said inclination sensing means, an angle not exceeding a first predetermined angle to cause said inflating means to terminate inflation of said inflatable member whereby the resultant buoyancy of the inflating member applies an upwardly directed force to the ice sheet in the predetermined area.

5. The apparatus of claim 4 which further includes means responsive to sensing, by said inclination sensing means, an angle exceeding a second predetermined angle for deflating said inflatable member until said inclination sensing means senses an angle not exceeding said second predetermined angle.

6. The apparatus of claim 4 or 5 in which a plurality of inflatable members are employed.

* * * * *